United States Patent [19]

Fritz et al.

[11] 4,170,916

[45] Oct. 16, 1979

[54] TOUCH OPERATED CAPACITIVE SWITCH FOR ELECTRONIC MUSICAL INSTRUMENTS

[75] Inventors: William L. Fritz, Cincinnati, Ohio; Walter Munch, Ft. Thomas, Ky.

[73] Assignee: D. H. Baldwin Company, Cincinnati, Ohio

[21] Appl. No.: 809,364

[22] Filed: Jun. 23, 1977

[51] Int. Cl.[2] ..... G10H 1/02

[52] U.S. Cl. ..... 84/1.24; 200/52 R; 200/DIG. 1; 340/365 C; 361/283

[58] Field of Search ..... 84/1.01, DIG. 7, 1.17, 84/1.24, 1.27; 200/52 R, DIG. 1; 340/365 C; 361/280, 283

[56] References Cited

U.S. PATENT DOCUMENTS

| | | | |
|---|---|---|---|
| 2,878,708 | 3/1959 | Hanert | 84/DIG. 7 |
| 3,198,055 | 8/1965 | Von Gunten | 84/1.17 X |
| 3,358,070 | 12/1967 | Young | 84/1.17 |
| 3,492,440 | 1/1970 | Cerbone et al. | 340/365 C X |
| 3,553,336 | 1/1971 | Markowitz | 84/1.17 X |
| 3,754,495 | 8/1973 | Honegger | 84/1.01 X |
| 3,757,024 | 9/1973 | Stinson, Jr. et al. | 84/1.17 |
| 3,760,243 | 9/1973 | Peroutky | 200/DIG. 1 |
| 3,836,909 | 9/1974 | Cockerell | 340/365 C |
| 3,911,780 | 10/1975 | Dyle et al. | 84/DIG. 7 |
| 3,943,812 | 3/1976 | Nagai et al. | 84/DIG. 7 |
| 3,971,013 | 7/1976 | Challoner et al. | 340/365 C X |
| 4,016,490 | 4/1977 | Weckenmann et al. | 200/DIG. 1 |
| 4,056,699 | 11/1977 | Jordan | 200/DIG. 1 |
| 4,064,688 | 12/1977 | Sasaki et al. | 200/DIG. 1 |

*Primary Examiner*—Stanley J. Witkowski
*Attorney, Agent, or Firm*—Frost & Jacobs

[57] ABSTRACT

A touch operated capacitive switch for altering electrical signals controlling the mode of operation of an electronic musical instrument. The switch comprises a thin laminate having a non-conducting lamina sandwiched between a conducting touch electrode and a conducting guard electrode, each electrode having an electrical connector for connecting the switch to alternating electrical signals having substantially the same phase and amplitude to reduce the capacitance between the touch electrode and points of ground potential located in or on the instrument for increasing the sensitivity of the switch. The switch is non-conductively secured to the instrument with the guard electrode facing the instrument, such that the capacitance of the switch may be altered by touching the touch electrode.

7 Claims, 4 Drawing Figures

TOUCH OPERATED CAPACITIVE SWITCH FOR ELECTRONIC MUSICAL INSTRUMENTS

BACKGROUND OF THE INVENTION

1. Field of the Invention

The apparatus of the present invention relates generally to devices for controlling the mode of operation of an electronic musical instrument, and more particularly to a touch operated capacitive switch for altering electrical signals controlling the mode of operation of an electronic musical instrument and having means for increasing the sensitivity of the switch.

2. Description of the Prior Art

Devices for changing the mode of operation of an electronic musical instrument upon command by a performer at any time during a musical performance are well known in the art. For example, individual mechanical switches have long been used with electronic keyboard instruments, such as organs and the like, to provide pleasing variations in pitch, timbre and rhythm, among others, to add interesting variation and color to a musical performance. However, heretofore it has been difficult for a performer to actuate such devices during a performance without interruption to the musical work being performed, such as occurs when the performer must remove his hands from a playing position on an instrument keyboard, for example.

One arrangement which has been proposed for overcoming this problem includes a touch actuated switching device mounted on the musical instrument in such a position that it can be activated by the performer's hands while in their playing position. In one proposal, the touch actuated switching device takes the form of an elongated pressure or diaphragm switch mounted on the keyslip of a keyboard instrument such that the keyboard and the switch may be touched simultaneously by the performer. Thus, when the performer wishes to alter a particular mode of operation of the instrument, he need merely press the switch at any point along its length with one or more fingers. It has been found, however, that this type of switch requires considerable applied pressure for its activation, placing an unnecessary burden on the performer to apply the proper pressure and insure that the switch has in fact been actuated. In addition, since the switch is mechanical in nature it is subject to possible mechanical wear and failure, resulting in increased operating and replacement costs, as well as reduced reliability.

It has also been suggested to use a touch operated capacitive switch of limited active area to permit change in the mode of operation of the musical instrument. The operation of such switches is well understood by those skilled in the art and need only be briefly described herein. In its usual form, the touch operated capacitive switch comprises a small conducting plate impressed with a small alternating voltage. The plate of the switch is so positioned and constructed that in its quiescent state it possesses minimal intrinsic capacitance. Hence, the alternating voltage applied to the plate of the capacitive switch produces a negligible quiescent current flow.

However, when the plate of the switch is touched, such as by the extended finger of a musical performer, the capacitance associated with the performer's body existing between his finger and ground, causes an increased current to flow from the plate of the switch. This increased current can be detected by any one of a number of conventional and well understood current detection circuits to provide a change of electrical state for changing the operational mode of the musical instrument as desired. It has been found, however, that the inherent capacitance associated with the human body is relatively small, producing a correspondingly small current change when the switch plate is touched. Hence, if the surface area of the switch plate is permitted to become too large, the quiescent current associated with the large plate may completely swamp a small current change caused by touching the plate, making detection of the latter current impossible. For this reason, capacitive touch switches associated with electronic musical instruments have heretofore been of relatively small size, and have been mounted on the instrument in a location preventing the performer from activating the switch without interrupting his performance. Consequently, capacitive touch switches spanning a substantial part of the length of a musical instrument keyboard, for example, have heretofore proved impractical.

Attempts have been made by prior art workers to neutralize the intrinsic capacitance associated with large capacitive touch switches, but such attempts have proved largely unsuccessful. For example, one method previously employed to neutralize the effect of the large capacitance has been to provide a current offset exactly equal to the quiescent current caused by the large plate capacitance, such as through a bridge network or constant current source. Having balanced out the quiescent current in this way, small changes in current caused by touching the plate of the switch are easily detected. It has been found, however, that the adjustment necessary to null the quiescent current is extremely critical; in addition, small changes in mechanical dimensions of the plate of the touch switch, such as might be caused by vibration or thermal expansion or contraction with changes in temperature, will unbalance the circuit, causing a significant decrease in sensitivity of the switch.

Attempts have also been made to reduce the intrinsic capacitance of the switch plate by locating the switch on the instrument at a place removed from points of ground potential. However, in some applications, for example where the touch switch is required to be mounted on a metallic keyslip adjacent a keyboard, it has proved impractical to reduce the intrinsic capacitance of the switch in this manner. Likewise, attempts to electrostatically shield the switch plate have also proved largely unsuccessful.

SUMMARY OF THE INVENTION

The present invention provides a touch operated capacitive switch for use with electronic musical instruments which is not subject to the limitations of prior art capacitive switches and does not require critical adjustment to insure optimum sensitivity for its operation.

The switch comprises a thin laminate, which may be of any desired dimensions, it being preferred that the switch be of elongate shape for mounting on a keyslip adjacent the keyboard of an electronic musical instrument such that the keyboard and the switch may be touched simultaneously by the performer. The laminate contains a thin insulating layer sandwiched between a conducting touch electrode plate and a conducting guard electrode plate. Each electrode is separately connected to sources of alternating voltage having substantially the same phase and amplitude which greatly reduce the intrinsic capacitance of the switch, as will be explained in more detail hereinafter.

The switch also contains means, such as a pressure sensitive adhesive, for non-conductively attaching the switch to the instrument with the guard electrode facing the instrument. Both electrodes may include electrical connecting means, such as terminal lugs, for connecting them to the sources of alternating voltage. When the touch electrode of the switch is touched, a detection circuit in association with the source of alternating voltage connected to the touch electrode senses the increased current to cause a change of state of associated circuitry to alter the mode of operation of the musical instrument.

Increased sensitivity of the switch may be realized by constructing the laminate such that the touch electrode is of lesser width than the guard electrode. In addition, the length of the switch may be such that it corresponds to the range of the instrument keyboard for which the action of the switch is to be effective, as will be described hereinafter.

DESCRIPTION OF THE PREFERRED EMBODIMENTS

Figure 1:
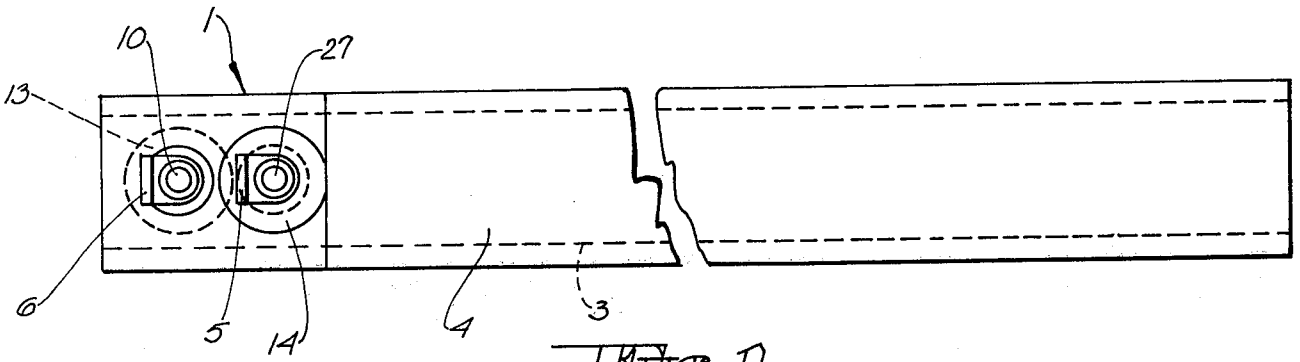
FIG. 1 is a fragmentary plan view of the touch operated capacitive switch of the present invention.
Figure 2:
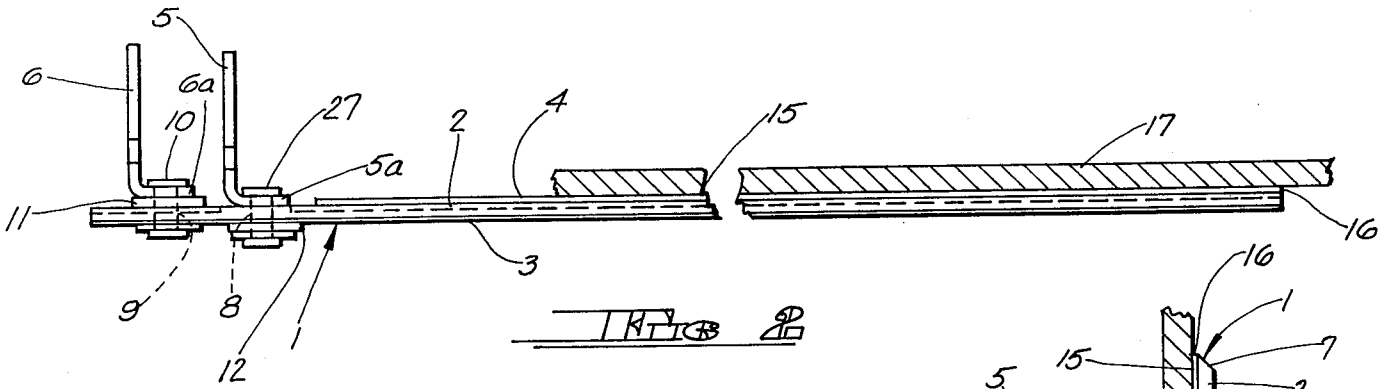
FIG. 2 is a fragmentary side elevation view of the touch switch of the present invention.
Figure 3:
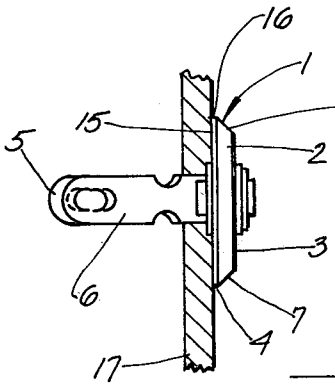
FIG. 3 is a partial schematic fragmentary end view of the touch switch of the present invention.

FIGS. 1–3 illustrate the touch operated capacitive switch, shown generally at 1. Switch 1 is of laminated construction, having an insulating layer 2 sandwiched between a conducting touch electrode 3 and a conducting guard electrode 4. Insulating layer 2 may comprise any type of non-conducting material, such as plastic, phenolic resin, or the like. Touch electrode 3 and guard electrode 4 comprise thin foil-like plates of conducting material, such as aluminum or the like, secured to opposite surfaces of insulating layer 2. As is best seen in FIG. 3, touch electrode 3 may be of lesser width than guard electrode 4 as will be explained hereinafter. In addition, the edges of insulating layer 2 may be beveled, such as at 7, to impart to the switch a substantially trapezoidal cross-section.

Electrical connecting means, such as terminal lugs 5 and 6, are attached to touch electrode 3 and guard electrode 4, respectively, near one end of switch 1. A pair of spaced apertures 8 and 9 are drilled through switch 1 for accepting rivets 27 and 10 to secure lugs 5 and 6 to switch 1. Lock washer 11 spaced between the leg portion **6*a* of lug 6 and guard electrode 4 provides a conductive path between electrode 4 and lug 6. In a similar manner, lock washer 12 spaced between rivet 27 and touch electrode 3 on the opposite side of switch 1 provides electrical contact between touch electrode 3, rivet 27 and the leg portion 5*a* of lug 5. In order to insure isolation, a portion 13 of touch electrode 3 has been removed in the area where rivet 10 is exposed on the touch electrode side of switch 1, to prevent an electrical path between touch electrode 3 and terminal lug 6. In a similar manner, a portion 14 of guard electrode 4 has been removed in the vicinity of the leg portion 5*a* of terminal lug 5 to isolate terminal 5 from guard electrode 4**. It will be understood by one skilled in the art that other types of electrical connections and isolating techniques may be used.

Switch 1 also contains means 15 for attaching switch 1 to a suitable part of the musical instrument, such as the grounded conducting keyslip of a keyboard electronic musical instrument, a portion of which is illustrated at 17. Inasmuch as the typical keyslip 17 will be constructed of a conducting material, it has been found advantageous to construct attaching means 15 using a non-conducting or insulating material. For example, attaching means 15 may comprise a non-conducting pressure sensitive adhesive applied to the outer surface of guard electrode 4 with the adhesive side of attaching means 15 facing keyslip 17. In one particular configuration, attaching means 15 comprises an adhesive backing applied to guard electrode 4 and protected by a peelable paper strip. Switch 1 may be attached to keyslip 17 by peeling away the protective paper strip and pressing the exposed adhesive attaching means 15 into contact with keyslip 17 to securely mount switch 1 on the musical instrument. A suitable recess, not shown, may be provided in keyslip 17 to provide clearance for terminal lugs 5 and 6, as required.

In addition, attaching means 15 may include a layer of resilient material, such as a sponge, rubber or plastic pad 16, interspersed between attaching means 15 and guard electrode 4. This resilient material 16 operates to absorb vibrations produced by the musical instrument to eliminate unwanted microphonic oscillations which could be transmitted through the switch to other parts of the instrument. It will be understood that other means may be used to attach the switch to the instrument, such as rivets, screws, etc.

In operation, circuit means 100 (see FIG. 3) comprising a source of low alternating voltage 101 is connected to touch electrode 3 by way of terminal lug 5 to impress the alternating voltage thereon. Circuit means 100 also includes current detection means 102 in association with the source of alternating voltage, which is also connected to touch electrode 3 by way of terminal lug 5, and is utilized to detect the change in current of the switch when the touch electrode is touched. A suitable voltage source and current detection means are described in more detail in pending application Ser. No. 808,607, filed June 21, 1977, and entitled DIGITAL ARPEGGIO SYSTEM FOR ELECTRONIC ORGAN, in the name of Walter Munch, inventor, and assigned to common assignee D. H. Baldwin Company.

In normal operation, the intrinsic capacitance existing between touch electrode 3 and conducting keyslip 17 is relatively high, producing a substantial current flow from the voltage source through touch electrode 3. Since the additional capacitance added to the circuit when the electrode 3 is touched by the performer is relatively small, thereby producing a correspondingly small change in current, the large quiescent current associated with the capacitance existing between touch electrode 3 and the conducting keyslip 17 tends to completely swamp the small change in current, thereby making detection of the latter very difficult.

It has been found, however, that by adding an additional guard electrode 4 interspersed between touch electrode 3 and conducting keyslip 17, touch electrode 3 is effectively shielded from nearby points of ground potential, such as keyslip 17. As described in more detail in the aforementioned pending application, a second source of low alternating voltage, having substantially the same amplitude and phase as the source of voltage connected to touch electrode 3, is connected through terminal lug 6 to guard electrode 4, thereby impressing an alternating voltage on guard electrode 4. Since substantially the same voltages are applied to touch electrode 3 and guard electrode 4, the potential difference existing therebetween is essentially zero, producing practically no current flow between these electrodes. Hence, the quiescent current is reduced substantially, and small change in current caused by touching touch electrode 3 may be easily detected. It will be understood, however, that the quiescent current cannot be eliminated entirely, inasmuch as some residual capacitance will exist between touch electrode 3 and other points of ground potential in the area of the switch. These so-called electrostatic fringing fields can be additionally reduced by constructing switch 1 such that guard electrode 4 is of greater width than touch electrode 3 so that guard electrode 4 provides more effective electrostatic shielding of touch electrode 3. In order to eliminate potentially hazardous sharp corners of the switch and improve its appearance, the edges of insulating layer 2 may be beveled as at 7 such that insulating layer 2 converges toward touch electrode 3.

It will be observed that with the introduction of guard electrode 4 impressed with an alternating voltage of substantially the same phase and amplitude as the voltage impressed on touch electrode 3, neither the capacitance existing between touch electrode 3 and guard electrode 4, nor the capacitance existing betweeb guard electrode 4 and points of ground potential, is critical, and dimensional changes among the electrodes and the keyslip will no longer adversely affect the sensitivity and operation of the switch.

Figure 4A:
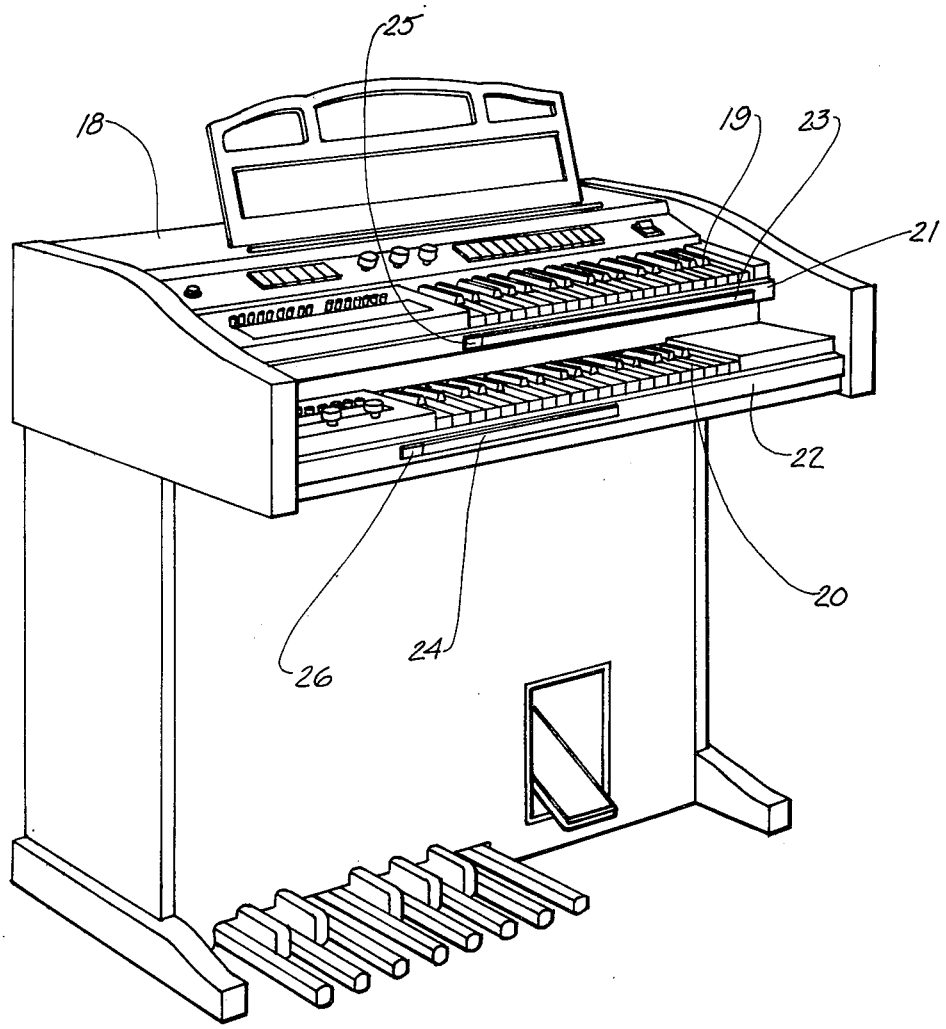
FIG. 4 is a perspective view of a typical electronic musical instrument having mounted thereon two touch operated capacitive switches.

FIG. 4 illustrates a typical keyboard electronic musical instrument 18 having an upper keyboard 19 and a lower keyboard 20. A conducting keyslip 21 is located adjacent to and below upper keyboard 19, while a similar conducting keyslip 22 is mounted adjacent to and below lower keyboard 20. A touch operated capacitive switch 23 extending approximately the length of upper keyboard 19 is mounted on upper keyslip 21 in a manner similar to that described hereinbefore for switch 1. In a like manner, touch operated capacitive switch 24 is mounted on lower keyslip 22 and spans approximately the lower one and one-half octaves of lower keyboard 20. Switch 23 is also mounted on keyslip 22 in a manner similar to that described hereinbefore for switch 1. It will be understood that switch 23 or switch 24 may be of any length and may be located anywhere on the instrument, depending upon the particular needs of the individual performer. For purposes of an exemplary showing and as illustrated in FIG. 4, upper switch 23 permits the performer to simultaneously contact keyboard 19 and switch 23 at any point along keyboard 19. On the other hand, lower switch 24 permits the performer to contact simultaneously keyboard 20 and switch 24 only when the performer is playing in the lower one and one-half octaves of keyboard 20. Finally, for the particular keyboard arrangement shown in FIG. 4, the performer may also contact upper switch 23 and lower keyboard 20 over the region of approximately the upper two-thirds of lower keyboard 20.

As described hereinbefore, recesses (not shown) may be provided in keyslips 21 and 22 to accept the electrical connecting means, such as terminal lugs, associated with switches 23 and 24. The end of switches 23 and 24 containing the electrical connecting means may also be provided with suitable insulators, such as an encapsulating block shown at 25 and 26, to guard against accidental electrical shock and to improve the appearance of the switch. The necessary circuitry for impressing alternating voltages on the touch and guard electrodes, as well as circuitry for detecting current changes in the touch electrode when this electrode is touched, may be located within the instrument as required. It will be understood that the switches may be provided with a decorative finish to match the style and appearance of the instrument upon which they are mounted.

It will be understood that various changes in the details, materials, steps and arrangement of parts, which have been herein described and illustrated in order to explain the nature of the invention, may be made by those skilled in the art within the principle and scope of the invention as expressed in the appended claims. For example, while the touch operated capacitive switch of the present invention has been described and illustrated in association with a keyboard electronic musical instrument, it will be understood that it may be used with other types of musical instruments, including those of the string, percussive, and wind varieties, among others.

The embodiments of the invention in which an exclusive property or privilege is claimed are defined as follows:

1. In an electronic musical instrument of the type having a keyboard including a plurality of keys and circuit means for generating electrical signals, a touch operated capacitive switch mounted adjacent said keyboard of the instrument for altering at least one of the generated signals, said touch switch comprising a thin elongated laminated strip spanning a plurality of keys, said laminate having a non-conducting lamina sandwiched between a conducting touch electrode and a conducting guard electrode, means for attaching said switch non-conductively to the instrument with said guard electrode facing the instrument, said touch electrode and said guard electrode each having an electrical connecting means for connecting said touch electrode and said guard electrode to said circuit means, whereby the capacitance of the switch may be altered by touching said touch electrode to cause a change in the operation of said circuit means.

2. The switch according to claim 1 wherein said touch electrode is of lesser width than said guard electrode.

3. The switch according to claim 2 wherein the longitudinal edges of said electrodes spanning said plurality of keys and the corresponding edges of said non-conducting laminae are beveled such that the switch assumes a substantially trapezodial cross section.

4. The switch according to claim 1 wherein said attaching means includes means for resiliently mounting said switch on the instrument for reducing microphonic vibrations induced in said switch by the instrument.

5. The switch according to claim 1 wherein said attaching means comprises a pressure sensitive adhesive applied to the outer surface of said guard electrode, whereby said switch may be adhesively adhered to the instrument.

6. The switch according to claim 1 wherein said electrical connecting means comprises a first terminal lug electrically connected to said touch electrode and a second terminal lug electrically connected to said guard electrode, said first and second lugs projecting from the guard electrode side of said switch.

7. The switch according to claim 1 wherein said instrument includes a grounded electrically conducting keyslip adjacent said keyboard and said switch is mounted upon said key slip.

* * * * *